US010820709B2

(12) United States Patent
Yang

(10) Patent No.: US 10,820,709 B2
(45) Date of Patent: Nov. 3, 2020

(54) FOLDABLE BED

(71) Applicant: Topsun Creative Design, Zhejiang (CN)

(72) Inventor: Baoqing Yang, HangZhou (CN)

(73) Assignee: TOPSUN CREATIVE DESIGN, Hangzhou (CN)

( * ) Notice: Subject to any disclaimer, the term of this patent is extended or adjusted under 35 U.S.C. 154(b) by 708 days.

(21) Appl. No.: 15/710,289

(22) Filed: Sep. 20, 2017

(65) Prior Publication Data

US 2018/0014654 A1 Jan. 18, 2018

Related U.S. Application Data

(63) Continuation of application No. PCT/CN2016/073026, filed on Feb. 1, 2016.

(30) Foreign Application Priority Data

Apr. 13, 2015 (CN) ..... 2015 2 0220286 U

(51) Int. Cl.
*A47C 17/70* (2006.01)
*A47C 17/68* (2006.01)

(52) U.S. Cl.
CPC ..... *A47C 17/70* (2013.01); *A47C 17/68* (2013.01)

(58) Field of Classification Search
CPC ..... A47C 1/143; A47C 4/283; A47C 17/64; A47C 17/645; A47C 17/68; A47C 17/70; A47C 19/005; F16B 12/52; F16B 12/24
See application file for complete search history.

(56) References Cited

U.S. PATENT DOCUMENTS 3,965,502 A * 6/1976 Bertram ..... A47C 17/645 5/111
2012/0047649 A1* 3/2012 Grace ..... A47C 17/64 5/110
2014/0115780 A1* 5/2014 Lah ..... A47C 19/00 5/111

FOREIGN PATENT DOCUMENTS

CH 250041 A * 8/1947 ..... A47C 17/70
CN 2315003 Y 4/1999
(Continued)

OTHER PUBLICATIONS

International Search Report for PCT/CN2016/073026 dated Apr. 28, 2015.
Written Opinion for PCT/CN2016/073026 dated Apr. 28, 2015.

*Primary Examiner* — Nicholas F Polito
(74) *Attorney, Agent, or Firm* — Thompson Coburn LLP

(57) ABSTRACT

The present utility model relates to a foldable bed comprising a bed surface, and further comprising side support rods and bottom support rod members; wherein the side support rods are connected with the bed surface; the bottom support rod members each comprise a first bottom support rod, a second bottom support rod and a support strip; the first bottom support rod is hinged with the second bottom support rod through a hinge shaft; the support strip is hinged to the first bottom support rod and is provided with a clamping groove; the second bottom support rod is provided with a protrusion fitted with the clamping groove; and a free end of the first bottom support rod and a free end of the second bottom support rod are respectively provided with a clamp fitted with the side support rod. Since the first bottom support rod and the second bottom support rod are connected directly through the hinge shaft and positions of the two bottom support parts when being unfolded can be fixed through the support strip, a traditional bottom support rod
(Continued)

member can be arranged in a foldable form and the size of the bottom support rod member after being folded is thereby decreased.

20 Claims, 4 Drawing Sheets

(56) References Cited

FOREIGN PATENT DOCUMENTS

| | | | | | |
|---|---|---|---|---|---|
| CN | 202908288 | U | | 5/2013 | |
| CN | 203736415 | U | | 7/2014 | |
| CN | 203828480 | U | | 9/2014 | |
| CN | 204797279 | U | | 11/2015 | |
| DE | 9108923 | U1 | * | 9/1991 | ..... A47C 17/645 |
| WO | 2016165452 | A1 | | 10/2016 | |

* cited by examiner

FOLDABLE BED

RELATED APPLICATION DATA

This application claims the benefit of PCT application PCT/CN2016/073026, filed Feb. 1, 2016, which claims priority to Chinese Patent Application No. 201520220286.4 filed with Chinese Patent Office on Apr. 13, 2015 and entitled "FOLDABLE BED", both of which are incorporated herein by reference in its entirety.

BACKGROUND

The present disclosure relates to a foldable bed which is unfolded when being used and is folded when not being used, such that the space occupied by the bed is very small and the bed is convenient to carry. However, existing foldable beds mostly consist of seat rods and leg rods and are folded section by section, and the seat rods and the leg rods cannot be folded since the sizes thereof are fixed. In actual use, limited by the sizes of the seat rods and the leg rods, the sizes of such foldable beds after being folded are still large. Moreover, it is very cumbersome to fold, assemble, and unfold this type of foldable bed.

The present disclosure solves the problem that it is cumbersome to fold and assemble the existing foldable bed and the space occupied thereby after folding is still large. In one aspect of the disclosure, a foldable bed comprises a bed surface, side support rods and bottom support rod members. The side support rods are removably connected with the bed surface. The bottom support rod members each comprise a first bottom support rod, a second bottom support rod and a support strip. The first bottom support rod is hinged or has a pivot connection with the second bottom support rod through a hinge shaft. The support strip is hinged to the first bottom support rod and is provided with a clamping groove or releasable latch. The second bottom support rod is provided with a protrusion fitted with the clamping groove. A free end of the first bottom support rod and a free end of the second bottom support rod are respectively provided with a clamp groove configured to releasably connect with the side support rod.

Because (i) the first bottom support rod and the second bottom support rod are connected directly through the hinge shaft and (ii) positions of the two bottom support parts when being unfolded can be fixed through the support strip, a traditional bottom support rod member can be arranged in a foldable form and the size of the bottom support rod member after being folded is thereby decreased.

Preferably, an open curved surface of the clamping groove faces the hinge point of the support strip and the first bottom support rod and partially surrounds the protrusion, and an inner side of the clamping groove is further provided with a guide surface which guides the protrusion as it is separated from the clamping groove.

By adopting such arrangement, locking and unlocking of the first and second bottom support rods can be realized through rotation towards one direction, such that the opening of the clamping groove face to the hinge point and the guide surface is arranged to facilitate unlocking.

Preferably, the second bottom support rod is provided in two separable parts: (i) a connecting rod, and (ii) a support rod segment removably connectable with the connecting rod. The connecting rod may be hinged with the first bottom support rod, and the support rod segment may be removably connected with the connecting rod in two orientations: (i) one where the side support clamps face in one direction, and (ii) one where the side support clamps face in opposite directions. In an example, the support rod segment may slide about the connecting rod (e.g., the connecting rod portion may slide into a hollow interior of the support rod segment) in the first orientation, and after removal from the connecting rod portion, the support rod segment may be rotated by 180° then reinserted over the connecting rod portion. By adopting such a mode of connecting the connecting rod and the support rod segment, the direction to which the support rod segment points can be changed to be the same as the direction to which the first bottom support rod points after folding, and the size after folding is further decreased.

Preferably, the foldable bed further comprises a pressing handle. The pressing handle may be hinged with the first bottom support rod through the hinge shaft. By providing the pressing handle, an area for acting on the bottom support can be increased such that the operation of the folding bed is more convenient to perform.

Preferably, the support rod segment comprises a sleeve around the connecting rod.

Preferably, the foldable bed further comprises elastic ropes. The elastic ropes each connect the connecting rod and the support rod segment.

Preferably, the pressing handle is provided with a hinge on a side facing away from the bed surface.

Preferably, the foldable bed further comprises a joint rod portion. The joint rod portion may each form a sleeve around the connecting rod and may be fixed with the connecting rod through the hinge shaft.

Preferably, the first bottom support rod is mounted on an outer side of the pressing handle. The joint rod portion and the support rod segment may be mounted on an inner side of the pressing handle. The inner side of the pressing handle may be provided with a track which clamps the joint rod portion and the support rod segment.

Preferably, the protrusion is a spacing rivet.

DETAILED DESCRIPTION

Figure 1:
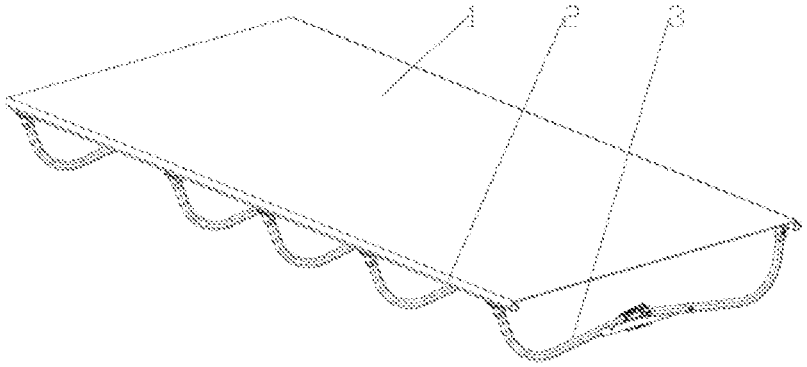
FIG. 1 is an overall schematic view of an exemplary foldable bed after unfolding.
Figure 2:
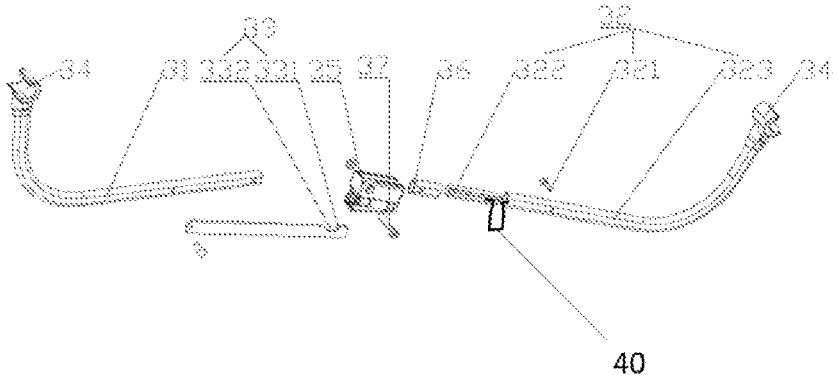
FIG. 2 is a schematic exploded view of a bottom support rod member of the foldable bed of FIG. 1.

FIG. 1 is an overall schematic view of an exemplary foldable bed after unfolding. It can be seen that the foldable bed in this embodiment comprises a bed surface 1, side support rods 2 and bottom support rod members 3. FIG. 2 is a schematic, exploded view of a bottom support rod member 3 of the exemplary foldable bed. It can be seen that the bottom support rod member 3 is provided with a first bottom support rod 31 and a second bottom support rod 32. The first bottom support rod 31 is hinged with the second bottom support rod 32 through a hinge shaft 37, and the first bottom support rod 31 and the second bottom support rod 32 are mutually rotatable. A free end of the first bottom support rod 31 and a free end of the second bottom support rod 32 are respectively provided with a clamp 34 towards their laterally outside ends, and the side support rods 2 can be clamped in the clamps. When the foldable bed is in an unfolded state, the first bottom support rods 31 and the second bottom support rods 32 drive the side support rods 2 laterally outward. This in turn drives the side support rods 2 laterally outward which in turn tightens the bed surface 1 as the bed surface 1 is clamped on the side support rods 2.

In the exemplary embodiment of the folding bed shown in the drawings, the first bottom support rod 31 is further provided with a support strip 33, the second bottom support rod 32 is provided with a spacing rivet 321, and the support strip 33 is provided with a clamping groove 331 which can clamp the spacing rivet 321. When the first bottom support rods 31 and the second bottom support rods 32 are unfolded to a proper angle and enable the bed surface 1 to be tightened, the support strips 33 maintain the positions of the first bottom support rods 31 and the second bottom support rods 32 relatively fixed.

Figure 3:
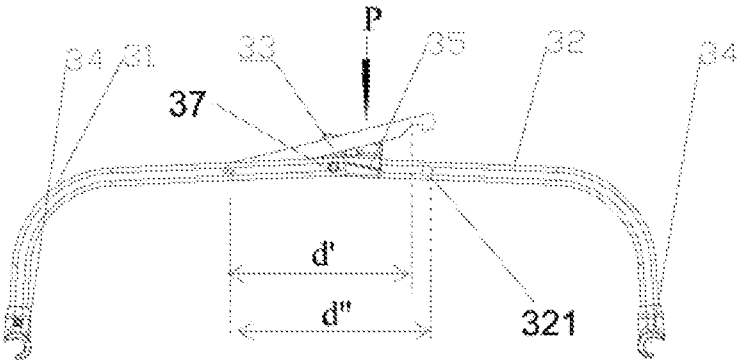
FIG. 3 is a schematic view of the bottom support rod member of FIG. 2 in an unlocked state t.
Figure 4:
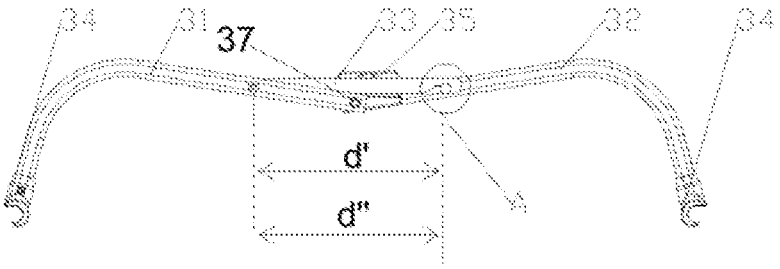
FIG. 4 is a schematic view of the bottom support rod member of FIG. 2 in a locked state.
Figure 5:
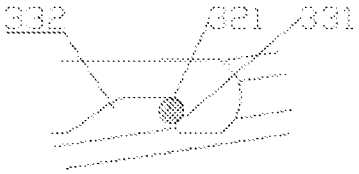
FIG. 5 is a schematic enlarged view of detail area A of FIG. 4.

FIG. 3 is a schematic view of the bottom support rod member 3 in an unlocked state of the foldable bed, FIG. 4 is a schematic view of the bottom support rod member 3 in a locked state of the foldable bed, and FIG. 5 is a schematic enlarged view of a detail area A of FIG. 4. The three drawings illustrate how the support strip 33 realizes fixation of the relative positions of the first bottom support rod 31 and the second bottom support rod 32. In the state illustrated in FIG. 3, (i) main body parts of the first bottom support rod 31 and the second bottom support rod 32 are substantially in line, and (ii) a distance (d') from a hinge point between the support strip 33 and the first bottom support rod 31 to the clamping groove 331 is smaller than a distance (d") from the hinge point to the spacing rivet 321. By pressing down along a direction shown by an arrow P, the first bottom support rod 31 and the second bottom support rod 32 are respectively downwards rotated at the position of the hinge shaft 37 such that the distance from the hinge point to the clamping groove 331 is decreased, the spacing rivet 321 is clamped at the clamping groove 331 when the position illustrated in FIG. 4 is reached, and a fitting relation between the clamping groove 331 and the spacing rivet 321 is achieved as illustrated in FIG. 5. At this position, the bed surface 1 is tightened and the entire foldable bed is arranged as illustrated in FIG. 1. When pressure is applied to the bed surface 1, the bed surface 1 moves downward and tends to drive two side support rods 2 closer to each other. The side support rods 2 tend to cause the first bottom support rod 31 and the second bottom support rod 32 to rotate along a direction opposite to the direction shown by the arrow P in FIG. 3 such that bottom areas of the two bottom support rods are in line, the distance from the spacing rivet 321 to the hinge point (d") has a tendency to increase. With this action, the clamping groove 331 in the support strip 33 tightly clamps the spacing rivet 321 such that the entire foldable bed is in a stable state. On the distal end of the support strip 33, an open curved surface of the clamping groove 331 faces toward the hinge point between the first bottom support rod 31 and the support strip 33 and forms a releasable latch for the support strip. An inner side of the clamping groove 331 is further provided with a guide surface 332.

Figure 6:
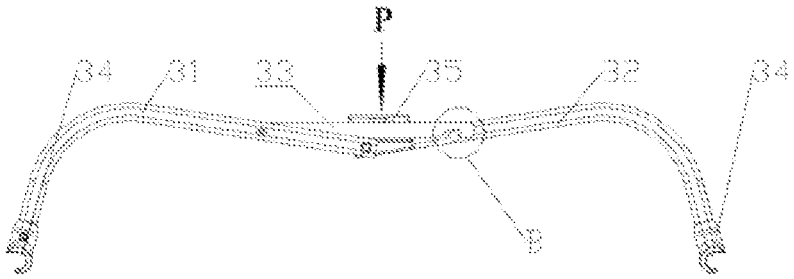
FIG. 6 is a schematic view of the bottom support rod member of FIG. 2 in a stage of the unlocking process.
Figure 7:
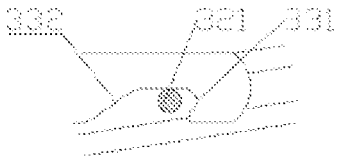
FIG. 7 is a schematic enlarged view of detail area B of FIG. 6.
Figure 8:
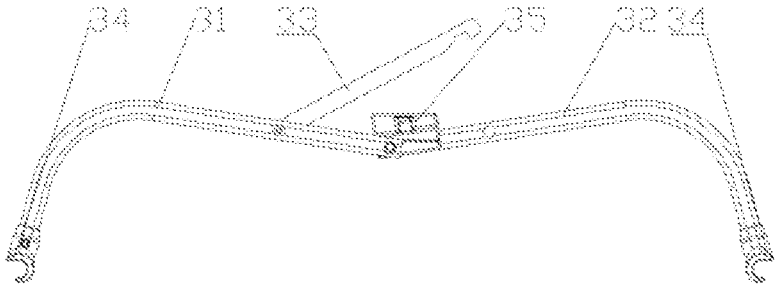
FIG. 8 is a schematic view of the bottom support rod member of FIG. 2 after unlocking.

FIG. 6 is a schematic view of the bottom support rod member 3 in the process of being unlocked, FIG. 7 is a schematic enlarged view of an area B in FIG. 6, and FIG. 8 is a schematic view of the bottom support rod member 3 after unlocking the foldable bed. When pressure is applied towards a direction shown by an arrow P in FIG. 6, the first bottom support rod 31 and the second bottom support rod 32 have a tendency to move downwards. The spacing rivet 321 may then be separated from the clamping groove 331 along the guide surface 332, as illustrated in FIG. 7. The support strip 33 may also include a lock to secure the support strip clamping groove 331 around the spacing rivet 321.

Figure 9:
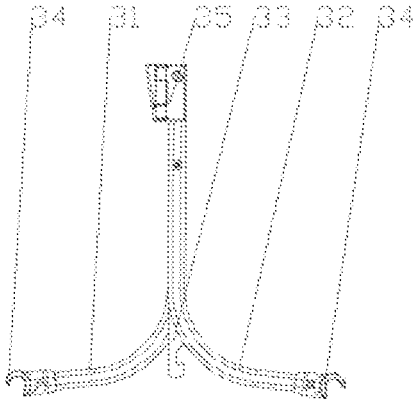
FIG. 9 is a schematic view of the bottom support rod member of FIG. 2 in a semi-folded state.
Figure 10:
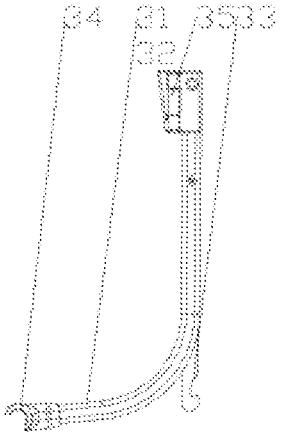
FIG. 10 is a schematic view of the bottom support rod member of FIG. 2 in a fully-folded state.

As illustrated in FIG. 2, the second bottom support rod 32 may be provided in two parts comprising a connecting rod 322 and a support rod segment 323. The connecting rod 322 may be hinged with the first bottom support rod 31. The support rod segment 323 is capable of sliding along the connecting rod 322 in an axial direction and being disassembled from the connecting rod 322. The support rod segment may have a hollow interior into which the connecting rod portion is received in removably connecting the support rod segment to the connecting rod portion. To facilitate a compact arrangement, the support rod segment 323 may be removed from the connecting rod 322. Then the support rod segment 323 may be rotated 180° around an axis. In this position, the support rod segment 323 is still capable of being inserted onto to the connecting rod 322. These specific steps are illustrated in FIG. 9 and FIG. 10. FIG. 9 illustrates that the first bottom support rod 31 and the second bottom support rod 32 are relatively rotated about the hinge shaft 37 to an arrangement where the free ends of the two bottom support rods point in opposite directions. While this space is small, a smaller arrangement may yet be achieved. The support rod segment 323 may be separated from the connecting rod 322, rotated by 180°, and then is remounted again with the connecting rod as illustrated in FIG. 10 such that the free ends of the two bottom support rods point in the same direction. It can be seen that the space occupied by the entire apparatus is further decreased. In this embodiment, the connecting rod 322 is disposed inside the hollow interior of the support rod segment 323. It can be imaged that the detachable connection between the connecting rod 322 and the support rod segment 323 may also be realized by adopting a sliding groove in a slidable connecting mode. The spacing rivet 321 may be mounted on the support rod segment 323 such that the function of the foldable bed can better realized.

The exemplary foldable bed may include a pressing handle 35 provided at the position of the hinge shaft 37 for connecting the first bottom support rod 31 and the second bottom support rod 32. The pressing handle 35 may be hinged with the second bottom support rod 32 through the hinge shaft 37. An outer side surface of the pressing handle 35, i.e., a surface in the direction shown in FIG. 3 and FIG. 6, is provided with a pressing handle surface.

When the bottom support rod member 3 is assembled or disassembled, the assembly or disassembly operation can be realized by pressing the pressing handle. The pressure that may be applied to the pressing handle may be increased, and the operation and use of the foldable bed may be facilitated. In order to further increase the pressure that may be applied to the surface of the pressing handle 35, the pressing handle application surface may be presented as a hinge. The hinge may be closed in a folded state and opened in a used state. While the pressing handle 35 assists in improving the convenience in operation of the foldable bed, the pressing handle may be omitted. Since the above-mentioned locking and unlocking can be realized in one direction as indicated by the arrow P, the two operations can be completed by pressing the pressing handle surface in the same direction, which makes the foldable bed very convenient to operate.

Because the diameter of the connecting rod 322 is smaller than the diameter of the support rod segment 323 and the diameter of the first bottom support rod 31, it may be inconvenient to fix the connecting rod 322 onto the pressing handle 35. A joint rod portion 36 may be further provided between the pressing handle 35 and the connecting rod 322. The cross-sectional shape of the joint rod portion 36 may be the same as the shape of the support rod segment 323 and the shape of the first bottom support rod 31. The joint rod portion 36 facilitates the connection between the pressing handle 35 and the connecting rod 322, and also eliminates a potential gap in the frame which may prevent foreign matter from entering the frame structure. The joint rod portion 36 may be connected with the connecting rod portion 322 with hinge shaft 37.

The positions of the pressing handle 35 and the second bottom support rod 32 may be relatively fixed. In order to realize fixation of the positions of the second bottom support rod 32 and the pressing handle 35, a corresponding clamping track for clamping the second bottom support rod 32 may be arranged on an inner side of the pressing handle 35 to engage the second bottom support rod, for instance, the joint rod portion 36. In this arrangement, the pressing handle 35 may be mounted toward an outer side of the first bottom support rod 31 with the hinge shaft 37 extending therebetween. The pressing handle 35, the second bottom support rod 32 and the first bottom support rod 31 may be thereby prevented from relatively rotating in an actual application.

Since the support rod segment 323 may be lost during actual carrying and disassembly of the foldable bed, an elastic rope 40 may be provided. The elastic rope connects the support rod segment 323 and the connecting rod 322. The elastic rope may be mounted on an inner side of the second bottom support rod 32. From FIG. 2, it can be seen that the connecting rod 322 is further provided with a groove for conveniently threading the elastic rope.

From FIG. 2, it can be seen that, in this embodiment, the first bottom support rod 31 and the second bottom support rod 32 are hinged through the hinge shaft formed by a bolt 37, and the support strip 33 is mounted on the first bottom support rod 31 through a rivet.

The side support rods 2 and the bed surface 1 may be also foldable structures. The side support rod and the bed surface may fold in an extension direction of the side support rods 2, such that the occupied space in the folded state is relatively small. When the foldable bed needs to be used, the bed surface 1 and the side support rods 2 may be unfolded. Then, at least two bottom support rod members 3 may be assembled to provide a supporting function.

The rod members may be hollow pipe members commonly used in the art. The rod members may also be solid rod members such as fiber rods and the like. While spacing rivets 321 are used for fitting with the clamping grooves 331, other protrusion parts which are fixedly mounted on the second bottom support rods may also be used.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A foldable bed comprising:

a bed surface;

side support rods adapted and configured to support the bed surface; and a plurality of bottom support rod members, each bottom support rod member being moveable between an expanded position and a folded position, each bottom support rod comprising a first bottom support rod, a second bottom support rod, and a support strip, the first and second bottom support rods having proximal and distal ends, the first bottom support rod being hingedly connected with the second bottom support rod through a hinge shaft at the proximal ends of the first and second support rods, the first bottom support rod distal end being positioned away from the second bottom support rod distal end across the first and second support rods when the bottom support rod member is in the expanded position, the support strip having a pivot connection with the first bottom support rod and having a clamping groove on its distal end opposite the pivot connection with the first bottom support rod, the second bottom support rod having a protrusion configured to be engaged by the clamping groove of the support strip, the support strip spanning the hinge shaft when the bottom support rod member is in the expanded position, the first bottom support rod and second bottom support distal ends each having a clamp configured to releasably connect with the side support rods.

2. The foldable bed according to claim 1, wherein the support strip clamping groove has an open curved surface that partially surrounds the protrusion and faces toward the pivot connection of the first bottom support rod and the support strip when the bottom support rod member is in the expanded position.

3. The foldable bed according to claim 1, wherein the support strip clamping groove has a guide surface which guides the protrusion into and out of the open curved surface of the clamping groove.

4. The foldable bed according to claim 1, wherein the second bottom support rod proximal end includes a connecting rod portion hingedly connected with the first bottom support rod.

5. The foldable bed according to claim 4, wherein the second bottom support rod includes a support rod segment removably connectable with the connecting rod portion.

6. The foldable bed according to claim 5, wherein the second bottom support rod support rod segment has a hollow interior adapted and configured to receive the connecting rod portion.

7. The foldable bed according to claim 5, wherein the second bottom support rod support rod segment is removably connectable with the connecting rod portion in first and second configurations of the second bottom support rod relative to the first bottom support rod.

8. The foldable bed according to claim 5, further comprising an elastic rope connecting the connecting rod portion with the support rod segment.

9. The foldable bed according to claim 5, wherein connecting rod portion includes a joint rod portion connected to the hinge shaft.

10. The foldable bed according to claim 1, further comprising a pressing handle hingedly connected with the first bottom support rod through the hinge shaft.

11. The foldable bed according to claim 10, wherein the pressing handle has a pressing surface arranged facing away from the bed surface when the bottom support rod member is in the expanded position.

12. The foldable bed according to claim 11, wherein the pressing handle has a track adapted and configured to releasably engage the second bottom support rod.

13. A foldable bed comprising:

a bed surface;

side support rods adapted and configured to support the bed surface; and a plurality of bottom support rod members, each bottom support rod member being moveable between an expanded position and a folded position, each bottom support rod comprising an upright portion and a width portion generally perpendicular to the upright portion, the upright portion generally defining a distance of the bed surface from a support surface on which the foldable bed is arranged when the bottom support rod member is in the expanded position, the width portions of the first and second bottom support rods being pivotally connected to each other through a hinge shaft with the first bottom support rod upright portion being positioned away from the second bottom support rod upright portion across width portions of the first and second support rods when the bottom support rod member is in the expanded position, the bottom support rod member further including a support strip pivotally connected with the first bottom support rod and having a releasable latch on its distal end opposite the pivot connection with the first bottom support rod, the second bottom support rod width portion having a protrusion configured to be engaged by the support strip releasable latch, the first bottom support rod and second bottom support upright portions each having a clamp configured to releasably connect with the side support rods.

14. The foldable bed according to claim 13, wherein the second bottom support rod width portion has first and second parts releasably connectable to each other.

15. The foldable bed according to claim 14, wherein the second bottom support rod width portion first part has a joint rod portion hingedly connected with first bottom support rod and a connecting rod portion extending from the joint rod portion.

16. The foldable bed according to claim 15, wherein the second bottom support rod width portion second part is removably connectable with the connecting rod portion.

17. The foldable bed according to claim 15, wherein the second bottom support rod width portion second part is removably connectable with the connecting rod portion in a first orientation wherein the first and second bottom support upright portion face in opposite directions with the bottom support rod member in the folded position and a second orientation wherein the first and second bottom support upright portion face in the same direction with the bottom support rod member in the folded position.

18. The foldable bed according to claim 15, further comprising an elastic rope connecting the connecting rod portion with the support rod segment.

19. The foldable bed according to claim 15, wherein connecting rod portion and the joint rod portion are connected to each other through the hinge shaft.

20. The foldable bed according to claim 13, further comprising a pressing handle hingedly connected with the first bottom support rod through the hinge shaft.

* * * * *